US005744773A

United States Patent [19]

Van Otteren et al.

[11] Patent Number: 5,744,773

[45] Date of Patent: Apr. 28, 1998

[54] RESISTANCE HEATING PROCESS AND APPARATUS

[75] Inventors: Robert G. Van Otteren, Bay City; Frank Scott Mellen, Midland, both of Mich.; Alfred R. Leger, North Grafton; Charles H. Gage, Westborough, both of Mass.

[73] Assignee: Newcor, Inc., Bloomfield Hills, Mich.

[21] Appl. No.: 531,106

[22] Filed: Sep. 19, 1995

[51] Int. Cl.[6] ..... C21D 9/62; H05B 3/02

[52] U.S. Cl. ..... 219/50; 72/342.96; 219/156

[58] Field of Search ..... 219/50, 155, 156; 72/342.1, 342.94, 342.96; 29/402.21

[56] References Cited

U.S. PATENT DOCUMENTS

| | | | |
|---|---|---|---|
| 454,698 | 6/1891 | Angell | 219/156 |
| 1,760,155 | 5/1930 | Macdonald | 219/156 |
| 3,114,034 | 12/1963 | Breuer et al. | 219/156 |
| 3,509,315 | 4/1970 | Breuer et al. | 219/156 |
| 3,737,618 | 6/1973 | Arnosky | 219/156 |

FOREIGN PATENT DOCUMENTS

| | | | |
|---|---|---|---|
| 397894 | 8/1965 | Switzerland | 219/156 |
| 120880 | 1/1959 | U.S.S.R. | 219/156 |
| 860855 | 2/1961 | United Kingdom | 219/156 |

*Primary Examiner*—Teresa J. Walberg
*Assistant Examiner*—J. Pelham
*Attorney, Agent, or Firm*—Flynn, Thiel, Boutell & Tanis, P.C.

[57] ABSTRACT

A process and apparatus for effecting preheating of elongate metal parts, such as bars, for permitting subsequent deformative processing of the bar. Electrode-type clamps are attached adjacent opposite ends of the elongate bar, and direct-current electricity is applied to the clamps for transmission longitudinally of the bar to effect heating thereof. A further pair of electrode-type clamps is applied directly at each free end of the bar, with the electrode clamps of each end pair being disposed for engagement on opposite sides of the bar substantially flush with the end face of the bar. An electric current, such as an alternating-current, is applied across the sidewardly-spaced electrode clamps of each end pair to effect transmission of electrical current transversely across the bar in the direct vicinity of the end face to effect additional heating directly at the end of the bar to supplement the heating which is effected by the direct-current passed longitudinally through the bar.

21 Claims, 5 Drawing Sheets

RESISTANCE HEATING PROCESS AND APPARATUS

FIELD OF THE INVENTION

This invention relates to an improved process and apparatus for electrical resistance heating of metal parts, such as elongate bars, for permitting subsequent processing thereof.

BACKGROUND OF THE INVENTION

Metal parts such as bars, rods and the like are typically heated either for purposes of metallurgical heat treatment or to prepare the parts for subsequent deformative processing, such as forging or roll forming. Attempts have been made to utilize electrical resistance heating of parts, and it has been observed that resistance heating of the part can be effective throughout the center or middle region thereof, but the ends of the part are typically insufficiently heated which, when coupled with the greater surface area and greater cooling rate of the ends, result in a preheating process which is inadequate since the preheating of the part longitudinally along the length thereof is nonuniform and prevents or at least detracts from the further processing thereof.

Accordingly, it is an object of the present invention to provide an improved process and apparatus for effecting preheating of elongate metal parts, such as bars, which preheating is highly desirable for permitting subsequent processing of the bar, while at the same time overcoming or at least minimizing the disadvantages which have been briefly described above.

Summarizing the process of this invention, electrode-type clamps are attached adjacent opposite ends of the elongate bar, and direct-current electricity is applied to the clamps for transmission longitudinally of the bar to effect heating thereof. This is effective for effecting heating longitudinally throughout a majority of the length of the bar, except for the very end portions of the bar. A further pair of electrode-type clamps is applied directly at each free end of the bar, with the electrode clamps of each end pair being disposed for engagement on opposite sides of the bar substantially flush with the end face of the bar. An electric current, such as an alternating-current, is applied across the sidewardly-spaced electrode clamps of each end pair so as to effect transmission of electrical current transversely across the bar in the direct vicinity of the end face to effect additional heating directly at the end of the bar to thus supplement the heating which is effected by the direct-current passed longitudinally through the bar.

In the process of this invention, as aforesaid, the electrical current which is supplied transversely across the end portions of the bar is preferably energized and applied to the end portions of the bar only after the longitudinal center portion of the bar has been observed to have reached a first predetermined elevated temperature. The energization of the current to and between the transverse end clamps then occurs and effects heating across the end portions of the bar to a second elevated temperature which is greater than said first temperature, although the direct-current is continued to be applied to the first pair of clamps to effect further heating and hence elevation of the temperature of the bar in the longitudinal direction thereof. The transverse heating of the end portions continues until the temperature of the end portions at least equals and possibly even slightly exceeds the temperature of the center portion of the bar, at which time the resistances heating is terminated, the bar is removed from the electrode clamps, and the subsequent processing operation (i.e., a forging or roll forming operation) is carried out.

Summarizing now the apparatus of the invention, as briefly described above, this apparatus includes a first pair of electrode-type clamps which are engaged with opposite longitudinally-spaced end portions of the bar, and a direct electrical current is applied to these clamps for transmission longitudinally through the bar to effect resistance heating thereof. Each clamp of the first pair preferably includes a pair of opposed clamp parts which directly engage opposite side surfaces of the bar in the vicinity of one of the ends thereof. Two pairs of second electrode-type clamps are also provided, each second pair being engaged at one longitudinal end of the bar. The second pair of clamps includes two clamps which are clampingly engaged with opposed side surfaces of the bar directly at the free end thereof, and an electrical current, an alternating-current in the preferred embodiment, is applied to the clamps of the second pair so as to pass transversely across the bar directly at the free end thereof to effect rapid heating of the bar substantially solely in the vicinity of the free end.

In the apparatus of the invention, as aforesaid, all of the clamps are preferably controlled by a pressure device, such as a fluid pressure cylinder, which controls movement of the clamp into engagement with a surface of the bar, and controls the clamping engagement and hence the pressure between the clamp and the bar. The clamps associated with the first pair are preferably mounted on heads which are positioned adjacent opposite longitudinal ends of the bar, each head also mounting one of said second pair of clamps thereon, and these heads are additionally supported so that one head is movable longitudinally toward or away from the other head so as to enable application of a tension or stretching force to the bar during the resistance heating operation. The apparatus of the invention, as aforesaid, also provides clamps having a clamping ridge thereon which extends transversely across a majority of a side face of the bar, which ridge has a small width in the longitudinal direction of the bar, to permit the electrical current passing from the clamp to the bar to be concentrated closely adjacent the end face of the bar to permit sufficient and effective heating of the bar longitudinally from one free end to the other free end thereof.

Other objects and purposes of the present invention will be apparent to persons familiar with structures and processes of this general type upon reading the following specification and inspecting the accompanying drawings.

Figure 1:
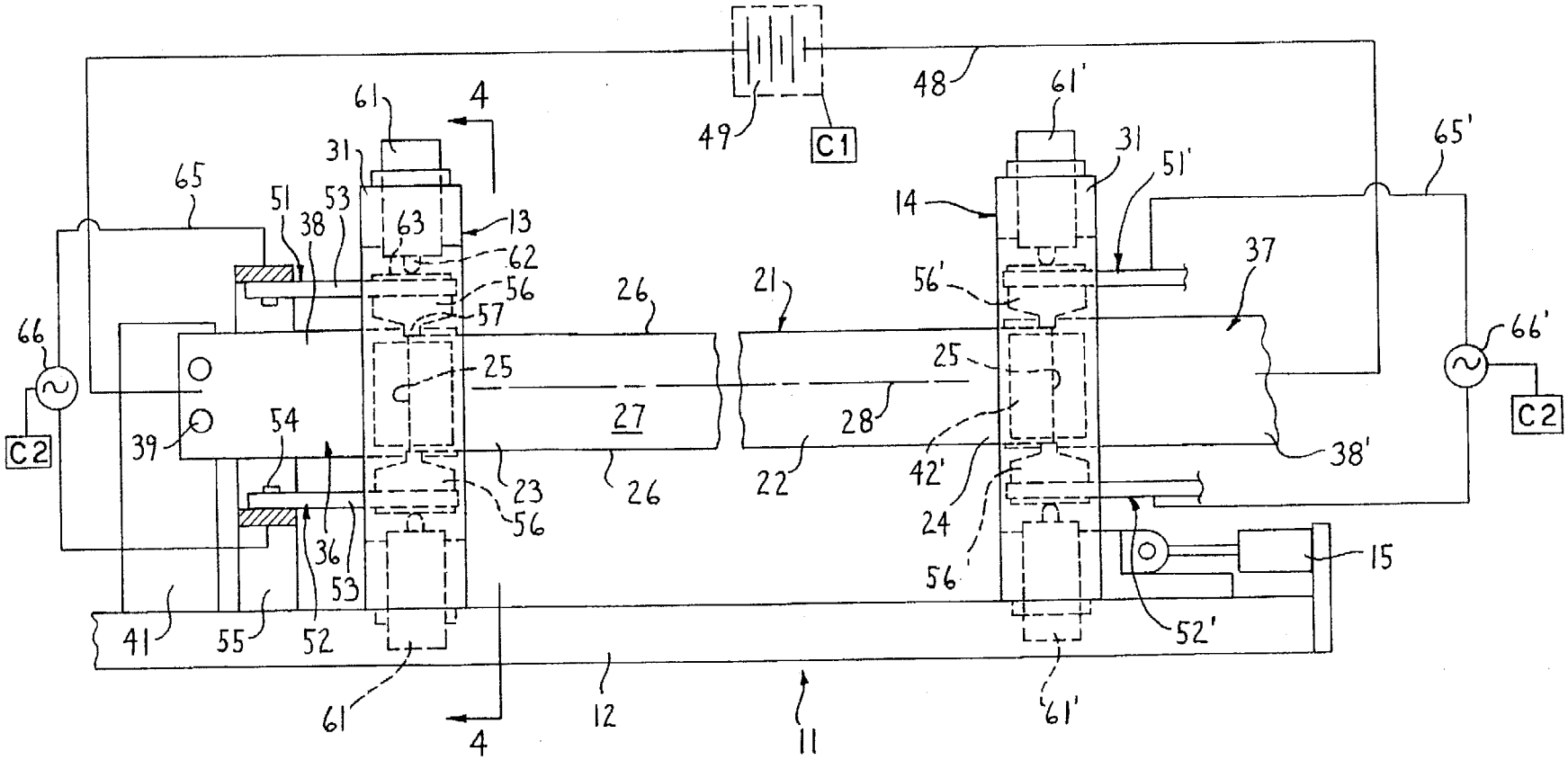
FIG. 1 is a fragmentary side elevational view illustrating the resistance heating apparatus of the present invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the apparatus and designated parts thereof. Said terminology will include the words specifically mentioned, derivatives thereof, and words of similar import.

DETAILED DESCRIPTION

Figure 2:
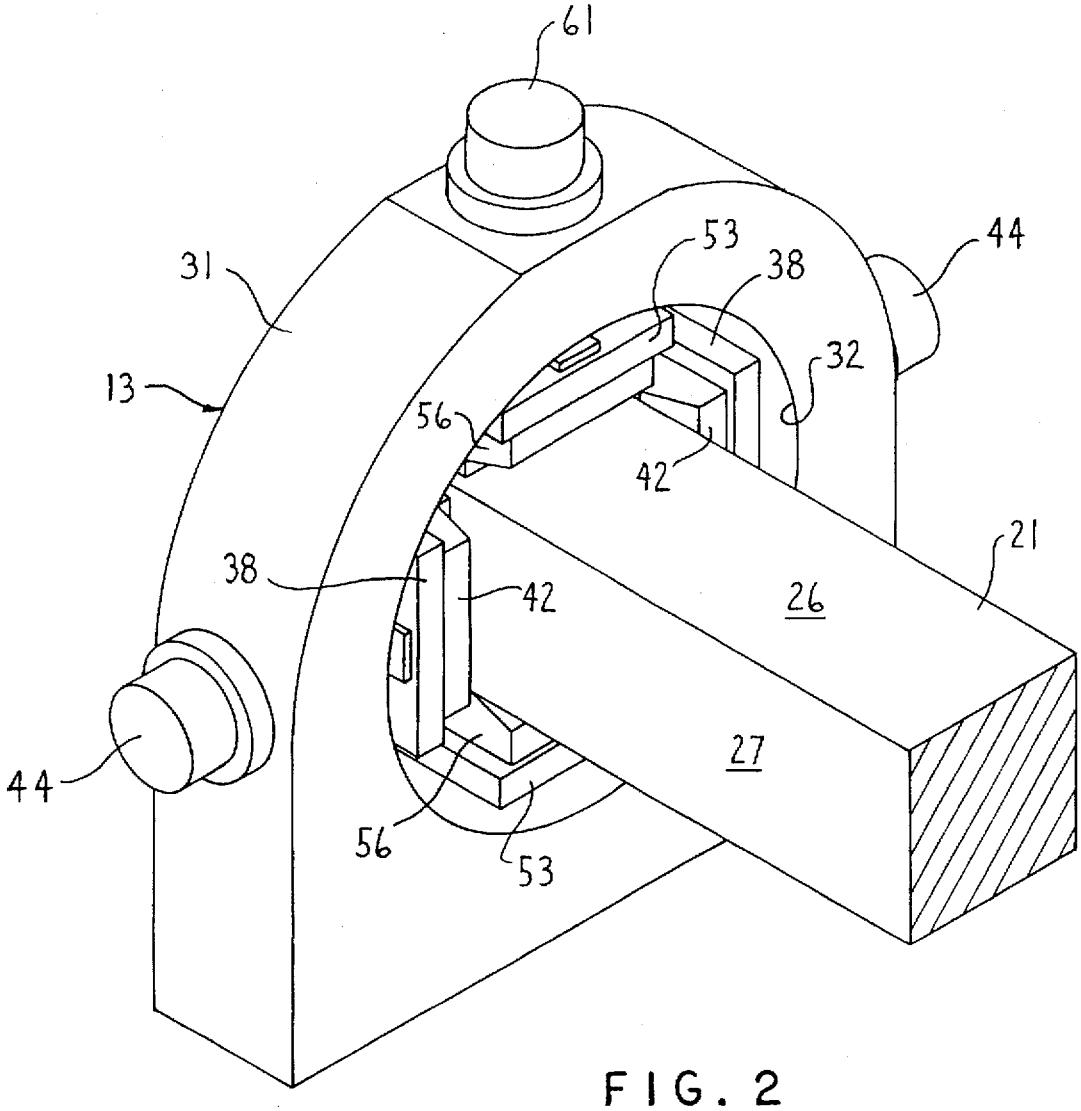
FIG. 2 is a fragmentary perspective view illustrating the support head associated with one end of the apparatus of FIG. 1.
Figure 3:
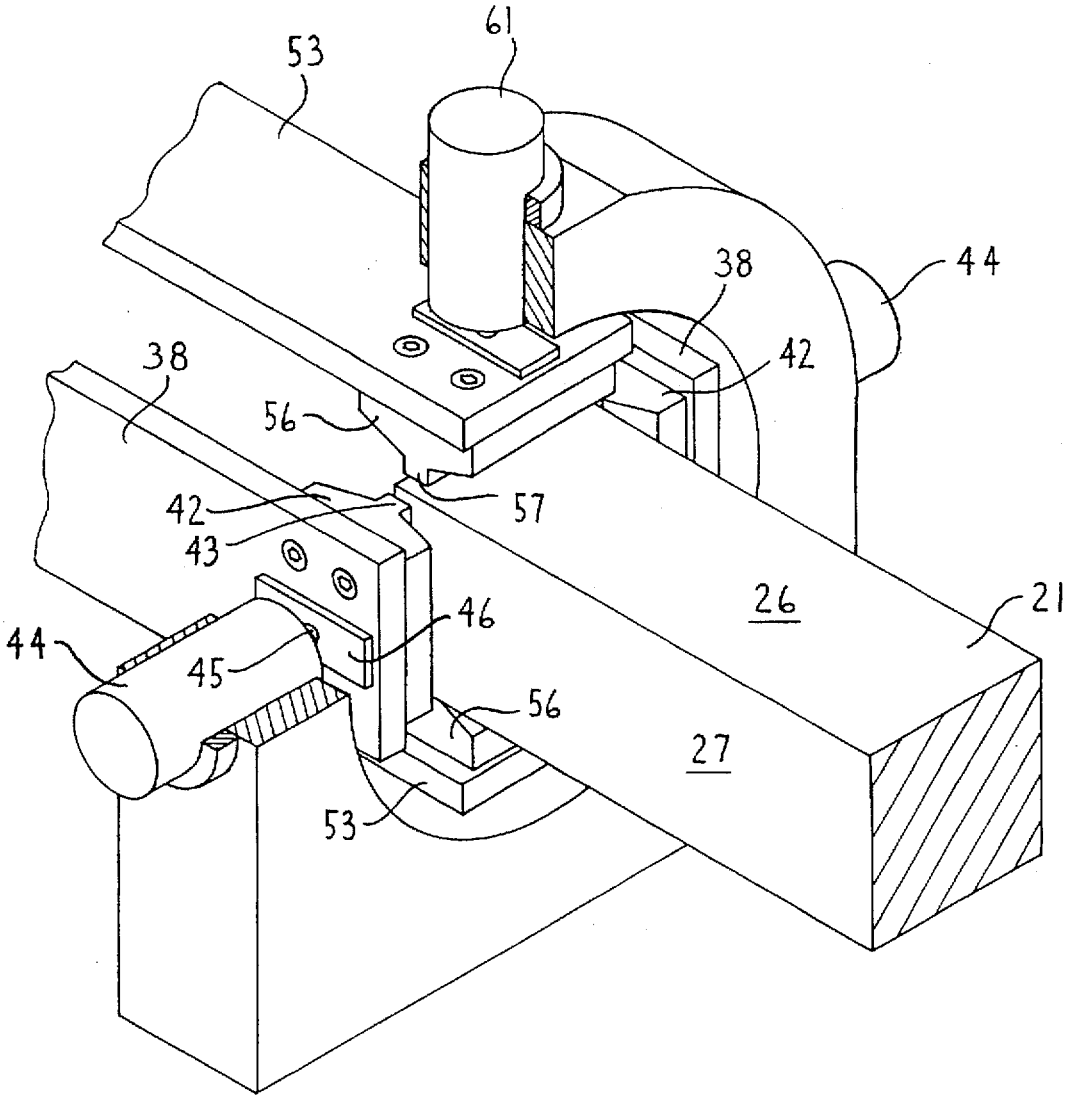
FIG. 3 is a view corresponding to FIG. 2 but showing the support ring broken partially away.
Figure 5:
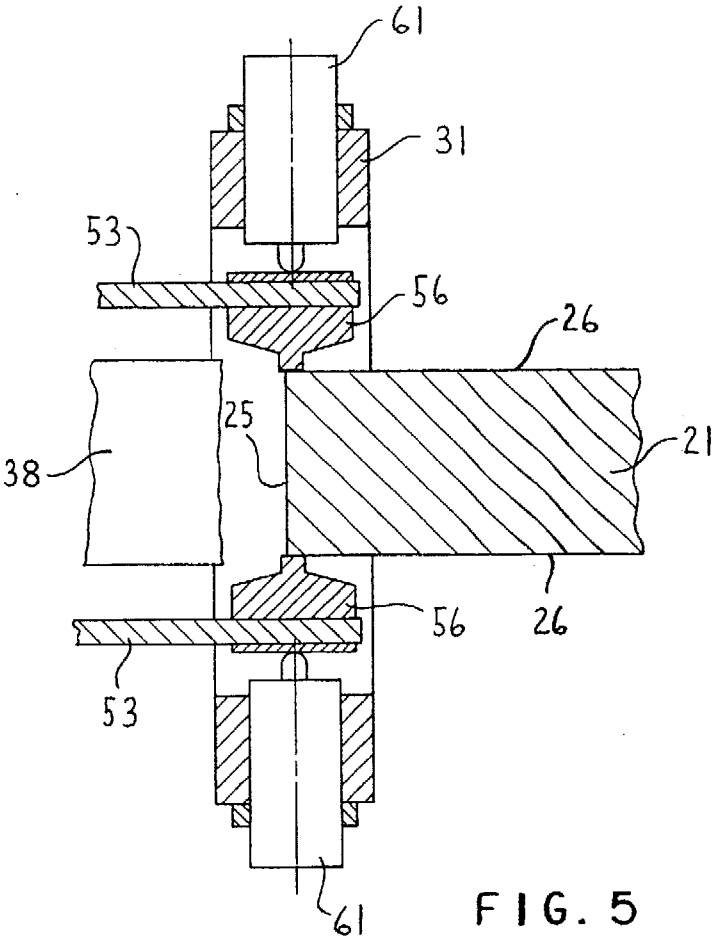
FIGS. 5 and 6 are views taken respectively along lines 5—5 and 6—6 in FIG. 4.
Figure 4:
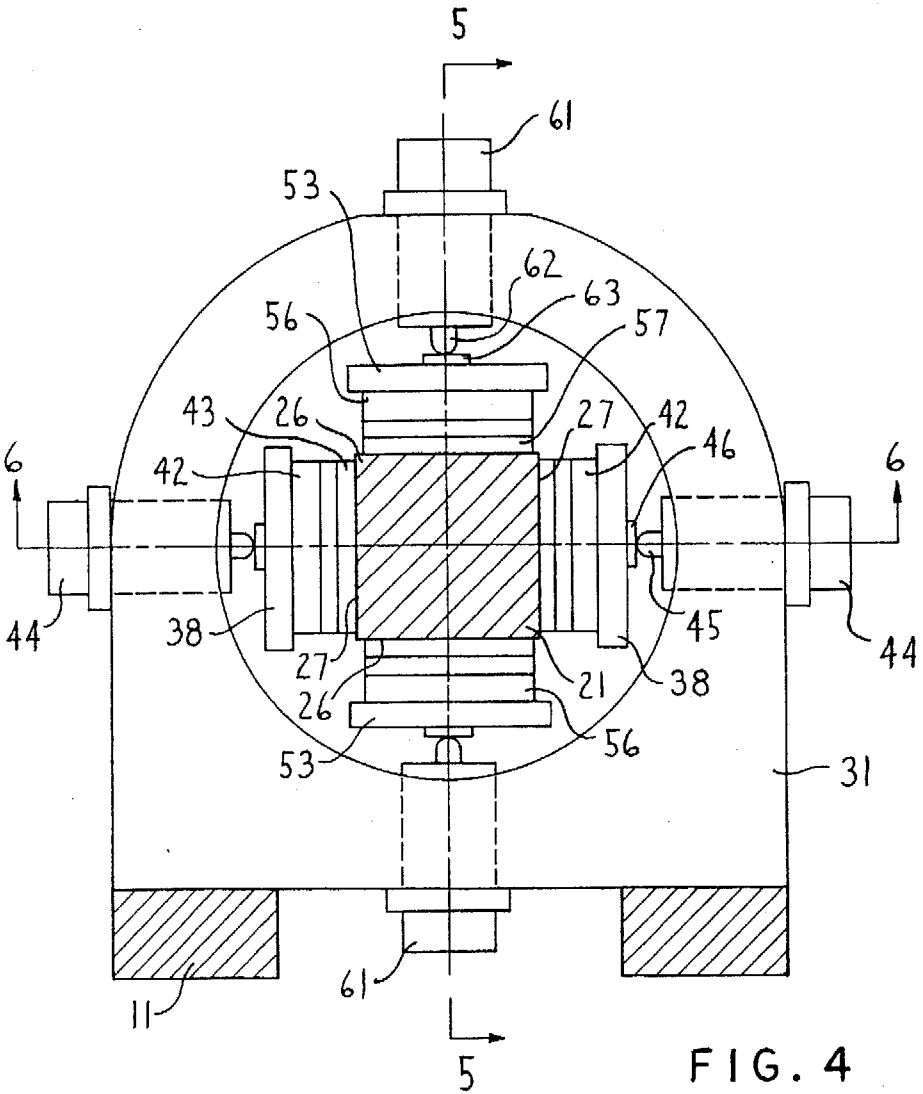
FIG. 4 is a view taken generally along line 4—4 in FIG. 1.

Referring to the drawings and specifically FIGS. 1–3, there is illustrated a resistance heating apparatus 11 according to the present invention. This apparatus includes a stationary frame 12 having a pair of support or collet assemblies 13 disposed thereon in longitudinally but opposed and spaced relation. At least one of the collet assemblies, the assembly 14 in the illustrated embodiment, is supported on the frame for slidable movement, and a drive device such as a pressure cylinder 15 is connected between the frame and the collet assembly 14 to enable the latter to be slidably and linearly disposed in a direction toward or away from the other collet assembly 13.

The collet assemblies 13 and 14 are adapted to supportingly engage an elongate metal workpiece 21 such as a bar, the latter having a longitudinally elongate center part 22 which extends between the collet assemblies and which terminates in longitudinally opposite end portions 23 and 24 which are respectively engaged by the collet assemblies 13 and 14. Each of the longitudinal end portions 23 and 24 terminates at a transversely-extending end face 25 which defines the free end of the bar 21.

The bar 21 in the illustrated embodiment has a rectangular, and more specifically a square, cross section so as to be defined by generally parallel side surfaces 26 which are disposed in parallel relationship to but are joined together by generally parallel opposed side surfaces 27. The bar 21 is longitudinally elongated along the longitudinal axis 28 thereof, the latter extending generally horizontally in the illustrated embodiment so as to be positioned in generally transversely and intersecting relation to the collet assemblies 13 and 14.

Each collet assembly 13 and 14 includes a generally ringlike support 31 having a generally cylindrical passage or opening 32 extending therethrough, which opening 32 is generally aligned with and along the longitudinal axis 28 of the bar 21.

To permit resistance heating of the bar 21 longitudinally along the length thereof, there is provided a first pair of clamps 36 and 37, the clamp 36 being associated with the collet assembly 13, and the clamp 37 being associated with the collet assembly 14. The clamp 36 includes a pair of generally elongate clamping members 38 which are disposed in sidewardly-spaced but generally parallel relation and extend longitudinally of the apparatus so that the outer or remote ends of the elongate clamping members 38 are secured by bolts 39 to a suitable mounting member 41. The securing arrangement of the clamping members 38 to the mounting member 41 is such as to provide for electrical insulation of the clamping members from the mounting member using conventional construction techniques. The elongate clamping members 38 are preferably constructed of an electrically conductive material, such as copper or copper alloy, and function as elongate cantilevered plates having at least limited resiliency. The clamping members 38 adjacent their free ends (the rightward ends in FIG. 1) are each provided with an electrode-defining jaw 42 fixed to the inner surface thereof, whereby the jaws 42 associated with the two clamping members 38 which define the first clamp 36 thus directly oppose or face one another. Each of the jaws 42 terminates in an inwardly facing bar-shaped contact surface 43 which is elongate transversely with respect to the longitudinal axis 28 and is adapted to make contact with one of the bar side surfaces 27 across substantially the full width thereof. This contact surface 43, however, is of small dimension in the longitudinal direction 28.

To activate the jaws 42 which are associated with the first clamp 36, a fluid pressure cylinder 44 is associated with each clamping member 38. The pressure cylinder 44 has the housing thereof mounted on the ringlike support 31 so that the movable piston rod 45 projects inwardly for contact with a contact plate 46 secured to the outer side of the clamping member 38 in the vicinity of the free end thereof. The two pressure cylinders 44 as provided on substantially diametrically opposite sides of the ringlike support 32, when substantially simultaneously energized, cause the two elongate clamping members 38 to be resiliently deflected inwardly toward one another so that the contact surfaces 43 associated with the opposed electrode-defining jaws 42 move into pressurized clamping engagement with the opposed parallel side surfaces 27 of the bar 21 in close proximity to the end surface 25.

The second clamp 37 as associated with the other collet assembly 14 is structurally and functionally substantially identical to the first clamp 36 as described above. Accordingly, corresponding parts thereof have been designated by the same reference numerals but with the addition of a prime (') thereto, whereby further detailed description of the second clamp 37 is believed unnecessary.

The first and second clamps 36 and 37 are connected to a circuit 48 which contains an electrical power supply 49, preferably a direct-current (i.e., DC) power supply. One end of the circuit connects to the two conductive clamping members 38 which define the first clamp 36, and the other end of the circuit connects to the two conductive clamping members 38' which define the second clamp 37. When the clamps 36 and 37 are thus disposed in clamping and conductive engagement with opposite end portions of the bar 21, a completed circuit is created, whereby the direct-current electrical energy is transmitted longitudinally of the bar 21 to effect resistance-induced heating thereof.

The apparatus 11 is also provided with an additional heating arrangement associated with at least one of the collet assemblies so as to permit transverse heating of the bar at one of the free ends thereof. As shown in FIGS. 1–3, the collet assembly 13 has a second pair of clamps 51 and 52 associated therewith for permitting conductive clamping engagement with the end portion 23 of the bar in close proximity to the end face 25. Each of the clamps 51 and 52 is defined by an elongate clamping member 53 which extends longitudinally outwardly away from the support ring 31 so that the outer end thereof is fixedly secured, as by bolts 54, to a stationary mounting member 55. The two clamping members 53 which respectively define the third and fourth clamps 51 and 52 are each mounted to the mounting member 55 in a conventional manner so as to effect a suitable electrical insulation therebetween. The elongate clamping members 53 are again constructed of an electrically conductive material, such as a copper or copper alloy, and have at least limited resiliency due to the elongated cantilevered construction thereof.

The two clamping members 53 defining the third and fourth clamps 51 and 52 are vertically-spaced apart so as to permit the end of the bar 21 to effectively project therebetween, and each clamping member 53 has an electrode-defining jaw 56 fixed to a side face thereof so that the two jaws 56 vertically directly oppose one another and are disposed for direct engagement with the opposed side faces 26 of the bar. Each electrode 56 has a transversely elongate or barlike contact surface 57 adapted to engage and extend transversely across the opposed side surface 26 of the bar, with the width of this contact surface 57 as viewed in the longitudinal direction 28 being small.

Figure 7:
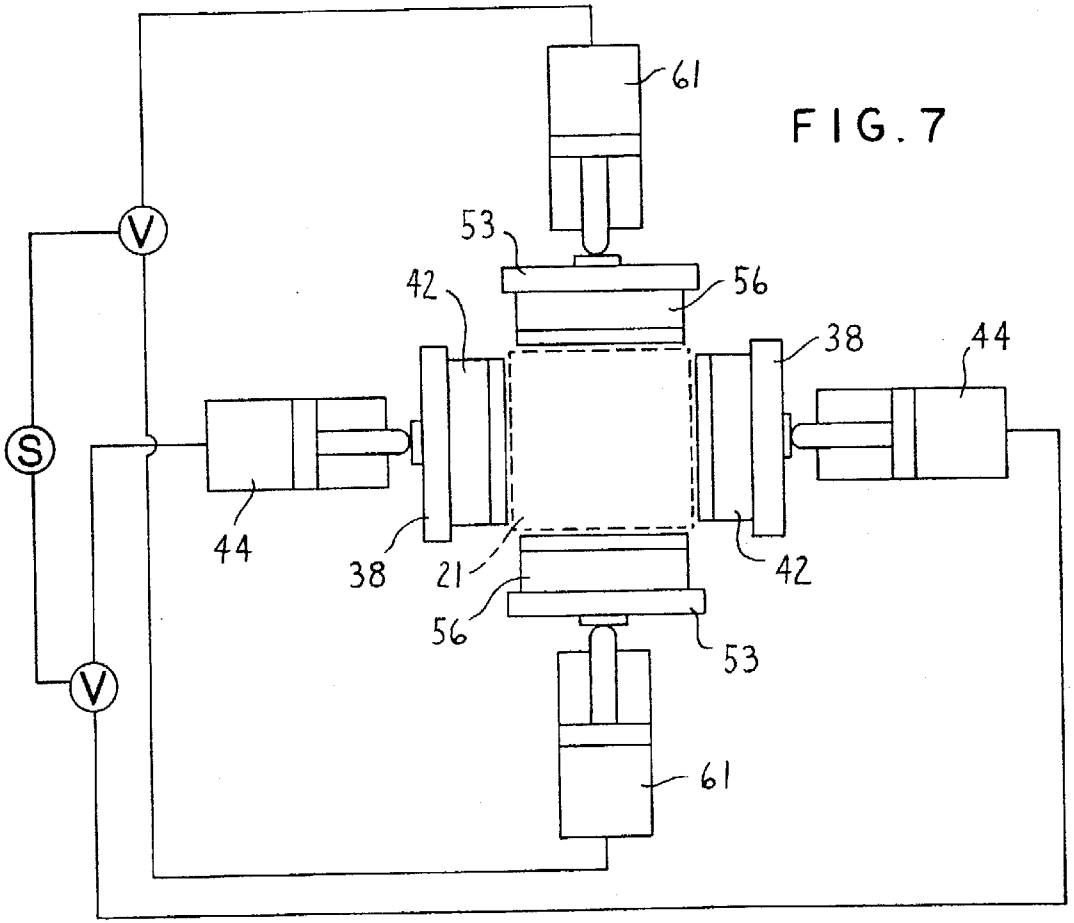
FIG. 7 is a diagrammatic view illustrating the pressure control circuits for the cylinders which activate the clamping electrodes.
Figure 6:
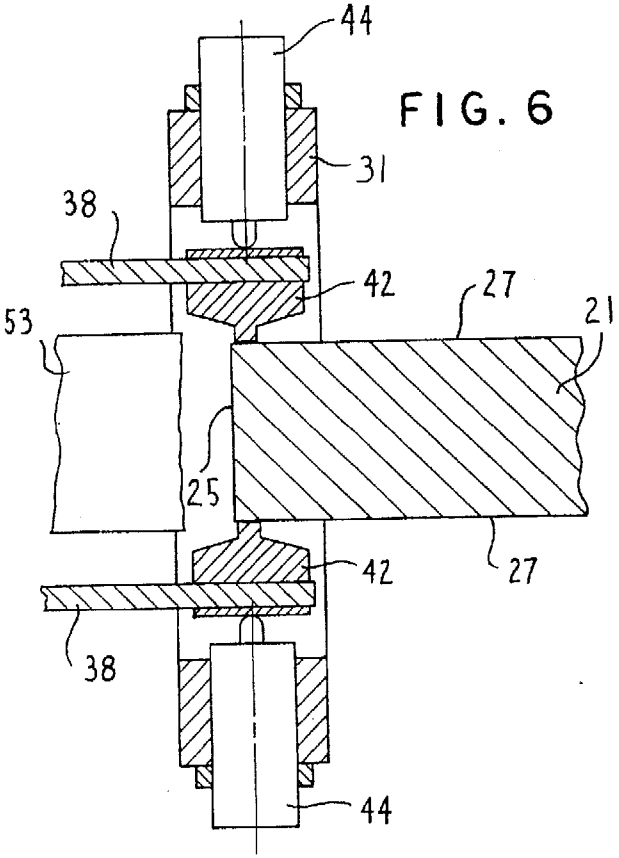

Each of the third and fourth clamps 51 and 52 has a pressure cylinder 61 associated therewith. The pressure cylinders 61 are mounted on the support ring 31 on generally diametrically opposite sides thereof, and each pressure cylinder has a piston rod 62 which extends inwardly for engagement with a contact plate 63 fixed to the outer side surface of the respective clamping member 53. The two pressure cylinders 61, when suitably and simultaneously energized from a pressure source, such as diagrammatically illustrated in FIG. 7, cause the elongate clamping members 53 defining the third and fourth clamps 51 and 52 to be resiliently deflected vertically toward one another so as to cause the jaws 56 to create a secure pressure and clamping engagement with the opposed side surfaces 26 of the bar 21 in very close proximity to the end face 25. In fact, it is preferred to have the end face 25 either intersect or be substantially aligned with an edge of the contact surfaces 57 so as to maximize transverse heating of the bar directly at the longitudinal end, although it has been experimentally observed that proper transverse heating occurs even if the contact surfaces 57 are only a small distance (for example, a fraction of an inch) away from the end face 25.

To supply electrical current to the clamps 51 and 52, there is defined an electrical circuit 55, one end of which connects to the third clamp 53, the other end of which connects to the fourth clamp 54, with the circuit being joined to a suitable electric power source 66 which can be direct-current, although use of an alternating-current (i.e., AC) power source is believed preferable to permit accelerated heating of the end portion of the bar.

While in some applications it may be necessary to provide a transverse heater associated with only one end of the bar, such as provided by the heating arrangement described above as associated with the collet assembly 13, nevertheless it is believed desirable in most applications to provide a similar such transverse heating arrangement associated with the other collet assembly 14 to permit transverse heating of the other end of the bar. Such transverse heating arrangement is shown in FIG. 1 in association with the other collet assembly 14, and such arrangement is identical to the transverse heating arrangement associated with the collet 13 and accordingly corresponding parts thereof are designated by the same reference numerals but with the addition of a prime (') thereto, so that further detailed description of the transverse heater provided on collet assembly 14 is believed unnecessary.

The operation of the apparatus 11 will now be briefly described.

The workpiece or bar 21 is positioned so that opposite end portions thereof are disposed generally within the collet assemblies 13 and 14, with the end faces 25 being disposed so as to be in close proximity to the electrode contact surfaces 57 on the collet assembly 13, with the opposite end surface of the bar as associated with the collet assembly 14 being similarly positioned. All of the pressure cylinders 44 and 61 on the collet assembly 13, and the corresponding cylinders on the collet assembly 14, are then energized so that the electrode jaws 42 and 56 respectively clamp the side surfaces 27 and 26 at one of the bar 21, and similarly the electrodes 42' and 56' associated with the collet assembly 14 similarly clamp the respective side surfaces 27 and 26 of the bar 21 at the other end thereof. All of the electrodes have an area of engagement which extends transversely across almost the full width of the respective side surface, with the width of the engagement area (in the longitudinal direction 28) being relatively narrow, but being disposed in close proximity to the respective end face 25. The longitudinal heating circuit 48 is then activated through a conventional control C1 so that direct-current electrical energy is transmitted longitudinally throughout the bar 21 to effect resistance heating thereof. In this fashion, the bar over a majority of the length thereof, except for the possibility of the free end portions, can be heated to a desired elevated temperature, such as to a temperature in the order of about 2,000° F. to about 2,300° F.

Simultaneous with or typically at some time after energization of the longitudinal heating circuit 48, the transverse heating circuits 65 and 65' are suitably activated, such as by a conventional control C2. When the circuit 65 and/or 65' is energized, this results in electrical energy being transmitted between the clamps 51 and 52 (or 51' and 52') so that the electrical energy is transmitted transversely across the end portion of the bar directly in the vicinity of the end face 25 thereof. This thus effects increased and accelerating heating of the end portion of the bar which, due to the significantly smaller volume of material being heated, can be heated rather rapidly to the desired temperature. For this purpose, the bar end portion as heated by the circuit 65 or 65' will normally be heated to a temperature which at least equals, and in some cases preferably slightly exceeds, the maximum heated temperature for the center portion of the bar as caused by the longitudinal heating circuit 48. In fact, it has been observed that typically the longitudinal heating circuit 48 will first be energized so as to effect longitudinally direct-current heating of the bar until the temperature of the longitudinal center portion of the bar reaches a temperature in the range of between about 1,500° F. and about 1,900° F. At that time the transverse heating circuits 65 and/or 65' are then energized so as to effect rapid transverse heating of the free end portions of the bar such that the end portions of the bar will thus achieve the desired maximum temperature (i.e., about 2,000° F. to about 2,300° F.) substantially at the same time as such maximum temperature is also achieved at the center of bar due to the direct-current longitudinal heating thereof. In this fashion, substantially uniform heating and hence temperature of the bar throughout the entire length can be achieved so as to facilitate further processing thereof.

While the temperature ranges noted above are typical where the next processing operation is a deformative one such as roll forming or forging, it will be appreciated that significantly lower temperatures may also be applicable, such as when effecting heat treating for metallurgical purposes.

If desired, the end portions may be heated to a slightly higher temperature since the greater surface area of the end portions increases the heat loss, and such higher temperature will thus tend to compensate for such heat loss during subsequent handling of the bar, but prior to the next processing thereof, so that the bar in its entirety is still substantially at equal or uniform temperature longitudinally throughout as the bar is subjected to the next processing step, such as a roll forming operation.

The conductive clamp members described above, such as the members 38, 38', 53 and 53', will be connected to suitable electrical conductors in a conventional manner, such being conventional and well known, particularly in electrical resistance welding equipment, so that further detailed description thereof is believed unnecessary.

Further, the electrodes 42, 42', 56 and 56' are preferably constructed of a material which possesses the ability to withstand high pressure and temperature, maintain a necessary hardness, and efficiently transmit electricity therethrough, such as a high-temperature copper alloy, typically a copper-tungsten alloy such as Elconite.

Although a particular preferred embodiment of the invention has been disclosed in detail for illustrative purposes, it will be recognized that variations or modifications of the disclosed apparatus, including the rearrangement of parts, lie with in scope of the present invention.

The embodiments of the invention in which an exclusive property or privilege is claimed are defined as follows:

1. An apparatus for electrical resistance heating of a longitudinally elongate metal workpiece having peripheral side surfaces, the workpiece having a longitudinally elongate center portion joined between opposite first and second end portions each terminating in a transversely-extending end face which defines a free end of the workpiece, said apparatus comprising:

a frame;

first and second collet assemblies mounted on said frame in generally opposed but spaced relation from one another for respectively supportingly engaging respective first and second end portions of the workpiece;

first electrical resistance heating means for applying direct-current electrical energy longitudinally along said workpiece for effecting resistance heating thereof, said first heating means including first and second jaw assemblies respectively provided on said first and second collet assemblies, for engaging a surface of the respective end portion of the workpiece in the vicinity of the respective end face, said first and second jaw assemblies respectively including first and second jaws each comprising an electrode for transmitting electrical current therethrough;

said first heating means also including a first direct-current electrical power source connected to said first and second jaw assemblies so as to define a conductive path longitudinally along said workpiece to effect resistance heating thereof due to passage of direct-current electrical energy longitudinally therethrough;

second electrical resistance heating means for transmitting electrical energy transversely across said first end portion of said workpiece in close proximity to the respective end face for effecting electrical resistance heating thereof, said second resistance heating means including third and fourth jaw assemblies both associated with said first collet assembly for clampingly engaging opposite peripheral side surfaces of said first end portion of said workpiece in directly adjacent relation to the respective end face, said third and fourth jaw assemblies respectively defining third and fourth jaws which are disposed in generally opposed relationship and cooperate as a pair for clampingly engaging opposed peripheral side surfaces of said first end portion of said workpiece therebetween, each of said third and fourth jaws comprising an electrode for transmitting electrical energy therethrough; and said second resistance heating means also including a second electrical power source connected to said third and fourth jaws for permitting electrical energy to be transmitted directly between said third and fourth jaws so as to be transmitted transversely across said first end portion of said workpiece in close relation with the respective end face to effect electrical resistance heating of said first end portion.

2. An apparatus for electrical resistance heating of a longitudinally elongate metal workpiece having peripheral side surfaces, the workpiece having a longitudinally elongate center portion joined between opposite first and second end portions each terminating in a transversely-extending end face which defines a free end of the workpiece, said apparatus comprising:

a frame;

first and second collet assemblies mounted on said frame in generally opposed but spaced relation from one another for respectively supportingly engaging respective first and second end portions of the workpiece;

first electrical resistance heating means for applying direct-current electrical energy longitudinally along said workpiece for effecting resistance heating thereof, said first heating means including first and second jaw assemblies respectively provided on said first and second collet assemblies, for engaging a surface of the respective end portion of the workpiece in the vicinity of the respective end face, said first and second jaw assemblies respectively including first and second jaws each comprising an electrode for transmitting electrical current therethrough;

said first heating means also including a first electrical power source connected to said first and second law assemblies so as to define a conductive path longitudinally along said workpiece to effect resistance heating thereof due to passage of electrical energy longitudinally therethrough;

second electrical resistance heating means for transmitting electrical energy transversely across said first end portion of said workpiece in close proximity to the respective end face for effecting electrical resistance heating thereof, said second resistance heating means including third and fourth law assemblies both associated with said first collet assembly for clampingly engaging opposite peripheral side surfaces of said first end portion of said workpiece in directly adjacent relation to the respective end face, said third and fourth jaw assemblies respectively defining third and fourth jaws which are disposed in generally opposed relationship and cooperate as a pair for clampingly engaging opposed peripheral side surfaces of said first end portion of said workpiece therebetween, each of said third and fourth jaws comprising an electrode for transmitting electrical energy therethrough; and said second resistance heating means also including a second electrical power source connected to said third and fourth jaws for permitting electrical energy to be transmitted directly between said third and fourth laws so as to be transmitted transversely across said first end portion of said workpiece in close relation with the respective end face to effect electrical resistance heating of said first end portion;

each of said first to fourth jaw assemblies comprising an elongate platelike clamping member constructed of an electrically conductive material, said elongate clamping member being fixedly mounted adjacent one end thereof and being cantilevered outwardly therefrom and having the respective jaw fixedly mounted adjacent the other end thereof, said jaw being provided on a side face of said clamping member adjacent said other end, said clamping member being resiliently deflectable, and an activating device for effecting resilient deflection of each said clamping member to effect movement of the respective jaw into clamping engagement with the workpiece.

3. An apparatus according to claim 1, wherein the first and second jaw assemblies respectively include an opposed pair of said first and second jaws which engage generally diametrically opposite sides of the respective end portion, and wherein the third and fourth jaws define a pair which respectively engage generally diametrically opposite sides of the respective end portion, the third and fourth jaws being disposed for movement toward and away from peripheral side surfaces of the respective end portion within a plane which extends generally perpendicularly with respect to a plane of movement of said pair of first jaws.

4. An apparatus according to claim 1, wherein each said jaw has a pressure contact area for engagement with the respective end portion which is transversely elongated relative to the longitudinal direction of the workpiece so as to engage and extend transversely across a majority of the width of the respective peripheral side surface, said contact area being of small width in said longitudinal direction.

5. An apparatus according to claim 4, wherein the pressure contact area on said third and fourth jaws is positioned for engaging respective peripheral side surfaces of the respective end portion directly at the respective end face.

6. An apparatus according to claim 1, including third resistance heating means associated with said second collet assemblies for transmitting electrical energy transversely across said second end portion of said workpiece directly adjacent the respective end face for effecting electrical resistance heating of said second end portion, said second resistance heating means including fifth and sixth jaw assemblies respectively having fifth and sixth jaws which directly clampingly engage opposed peripheral side surfaces of said second end portion directly adjacent the respective end face, said fifth and sixth jaws each being of an electrically conductive material and electrically joined to an electrical energy source for permitting electrical energy to be transmitted therebetween transversely across said second end portion to effect heating thereof.

7. An apparatus according to claim 1, wherein one of said collet assemblies is supported on said frame for movement toward and away from the other collet assemblies so as to vary the spacing therebetween, and an activating device connected between said frame and said one collet assembly for effecting movement thereof toward or away from said other collet assembly.

8. An apparatus according to claim 1, wherein said workpiece has a first pair of oppositely facing side surfaces positioned for engagement with said first jaws, said workpiece also having a second pair of oppositely facing side surfaces positioned for engagement with the respective third and fourth jaws, said second side surfaces being positioned individually between and extending generally perpendicularly with respect to said first side surfaces, said pair of first jaws and said third and fourth jaws being disposed generally within a rectangular array so that said first jaws are disposed on one pair of opposite sides of said rectangular array and said third and fourth jaws are disposed on the other pair of opposite sides of said rectangular array, said first collet assembly including a ringlike support disposed generally in surrounding relationship to the rectangular array of jaws and having a central opening therethrough in which said jaws are positioned, a first pair of pressure cylinders mounted on said ringlike support generally on diametrically opposite sides thereof and individually cooperating with said first jaws for effecting inward movement thereof for clamping engagement with the end portion of the workpiece, and a second pair of pressure cylinders mounted on the ringlike support generally on diametrically opposite sides thereof and disposed for direct cooperation with said third and fourth jaws for effecting inward movement thereof for clamping engagement with the end portion of the workpiece.

9. A process for effecting electrical resistance heating of a longitudinally elongate rodlike metal workpiece, comprising the steps of:

providing a longitudinally elongate rodlike metal workpiece having a longitudinally elongate center portion joined between first and second end portions each terminating in an end face which defines a free end of the workpiece, the end portions having first and second pairs of generally parallel and opposite peripheral side surfaces;

attaching first and second electrodes to the respective first and second end portions of said workpiece;

transmitting direct-current electrical energy longitudinally along said workpiece from one of said first and second electrodes to the other of said first and second electrodes to effect resistance heating of the bar by applying direct-current electrical energy to said first and second electrodes;

attaching third and fourth electrodes to diametrically opposite side surfaces of said first end portion in directly adjacent relationship to the respective end face; and transmitting electrical energy transversely across said first end portion between said third and fourth electrodes to effect resistance heating of said first end portion by applying electrical energy to said third and fourth electrodes simultaneous with the application of electrical energy to said first and second electrodes.

10. A process according to claim 9, including the steps of: initially supplying electrical energy solely to said first and second electrodes so as to effect longitudinal heating of said workpiece to a first predetermined temperature, and thereafter also supplying electrical energy to said third and fourth electrodes while continuing to supply electrical energy to said first and second electrodes so as to effect resistance heating of both the longitudinal center portion and the first end portion until both the first end portion and the center portion reach at least a second predetermined temperature which is greater than said first temperature.

11. A process according to claim 10, including the step of: continuing to supply energy to said third and fourth electrodes to cause resistance heating of said first end portion until it reaches a third predetermined temperature which is slightly greater than said second temperature as achieved at said center portion of said workpiece.

12. A process according to claim 10, wherein said first temperature is in the range of about 1,500° F. to about 1,900° F., and wherein said second temperature is in the range of about 2,000° F. to about 2,300° F.

13. A process according to claim 9, including the steps of attaching fifth and sixth electrodes to diametrically opposite peripheral side surfaces of said second end portion in close proximity to the respective end face, and transmitting electrical energy transversely across said second end portion between said fifth and sixth electrodes to effect electrical resistance heating of said second end portion directly adjacent the respective end face.

14. A process according to claim 9, wherein direct-current electrical energy is applied to said first and second electrodes, and wherein alternating-current electrical energy is applied to said third and fourth electrodes.

15. An apparatus according to claim 1, wherein said second electrical power source provides alternating-current electrical energy for transmission transversely across said first end portion of said workpiece.

16. An apparatus according to claim 15, wherein said first power source provides said direct-current and said second power source provides said alternating-current simultaneously to simultaneously heat said workpiece longitudinally and transversely.

17. An apparatus for electrical resistance heating of a longitudinally elongate metal workpiece having peripheral side surfaces, the workpiece having a longitudinally elongate center portion joined between opposite first and second end portions each terminating in a transversely-extending end face which defines a free end of the workpiece, said apparatus comprising:

a frame;

support means mounted on said frame for respectively supportingly engaging said first and second end portions of said workpiece;

electrical resistance heating means for applying electrical energy through said workpiece for effecting resistance heating thereof, said heating means including first and second jaw assemblies provided on said support means for engaging respective spaced apart first and second surface sections of the peripheral side surfaces of said workpiece, said first and second jaw assemblies respectively including first and second jaws each comprising an electrode for transmitting electrical current therethrough;

said heating means also including an electrical power source connected to said first and second jaw assemblies so as to define a conductive path between said first and second surface sections through said workpiece to effect resistance heating thereof due to passage of said electrical energy therethrough; and at least one of said first and second jaw assemblies comprising an elongate plate-like clamping member constructed of an electrically conductive material, said elongate clamping member being fixedly mounted adjacent one end thereof and being cantilevered outwardly therefrom and having the respective jaw fixedly mounted adjacent the other end thereof, said respective jaw being provided on a side face of said clamping member adjacent said other end, said clamping member being resiliently deflectable, and an activating device for effecting resilient deflection of said clamping member to effect movement of the respective jaw into clamping engagement with the respective surface section of the workpiece.

18. An apparatus according to claim 17, wherein said first and second surface sections are disposed on opposite sides of said first end portion and said first and second jaw assemblies clampingly engage said first end portion in directly adjacent relation to the respective end face, said first and second jaws being disposed in generally opposed relationship and cooperating as a pair for clampingly engaging said first and second surface sections of said first end portion of said workpiece therebetween.

19. An apparatus according to claim 17, wherein said first and second surface sections are longitudinally spaced apart proximate said first and second end portions respectively, said first and second jaws contacting said first and second surface sections so as to define a conductive path extending longitudinally therebetween to effect said resistance heating thereof due to the passage of said electrical energy therebetween.

20. An apparatus according to claim 19, wherein said first and second jaw assemblies respectively include an opposed pair of said first and second jaws, said pair of first jaws and said pair of second jaws engaging diametrically opposite sides of said respective end portions.

21. An apparatus according to claim 17, wherein the other of said first and second jaw assemblies comprises an elongate plate-like clamping member constructed of an electrically conductive material, said elongate clamping member being fixedly mounted adjacent one end thereof and being cantilevered outwardly therefrom and having the respective jaw fixedly mounted adjacent the other end thereof, said respective jaw being provided on a side face of said clamping member adjacent said other end, said clamping member being resiliently deflectable, and an activating device for effecting resilient deflection of each said clamping member to effect movement of the respective jaw into clamping engagement with the workpiece.

* * * * *

UNITED STATES PATENT AND TRADEMARK OFFICE

CERTIFICATE OF CORRECTION

PATENT NO. : 5,744,773

DATED : April 28, 1998

INVENTOR(S) : Robert G. Van Otteren et al

It is certified that error appears in the above-indentified patent and that said Letters Patent is hereby corrected as shown below:

Column 8, line 30; change "law" to ---jaw---.
line 40; change "law" to ---jaw---.
line 55; change "laws" to ---jaws---.

Signed and Sealed this

Nineteenth Day of January, 1999

*Attest:*

*Attesting Officer*

*Acting Commissioner of Patents and Trademarks*